US005909873A

United States Patent [19]

Littleton

[11] Patent Number: 5,909,873

[45] Date of Patent: Jun. 8, 1999

[54] NON MARKING SLOW DOWN APPARATUS

[75] Inventor: Francis J. Littleton, Alden, N.Y.

[73] Assignee: Littleton Industrial Consultants, Inc., Alden, N.Y.

[21] Appl. No.: 08/867,733

[22] Filed: Jun. 3, 1997

[51] Int. Cl.[6] ..... B65H 5/34

[52] U.S. Cl. ..... 271/270; 271/183; 271/216; 271/202

[58] Field of Search ..... 271/183, 151, 271/216, 202, 270

[56] References Cited

U.S. PATENT DOCUMENTS

| | | | |
|---|---|---|---|
| 3,178,174 | 4/1965 | Schneider . | |
| 3,212,775 | 10/1965 | Taylor | 271/202 |
| 3,224,761 | 12/1965 | Meyer-Jagenberg . | |
| 3,315,956 | 4/1967 | Lyman | 271/202 |
| 3,336,028 | 8/1967 | Schonmeier . | |
| 3,380,734 | 4/1968 | Laumer | 271/202 |
| 3,791,269 | 2/1974 | Sawada . | |
| 4,019,731 | 4/1977 | Vits . | |
| 4,200,276 | 4/1980 | Marschke . | |
| 4,221,377 | 9/1980 | Bodewein et al. . | |
| 4,405,125 | 9/1983 | Kulpa et al. . | |
| 4,436,302 | 3/1984 | Frye et al. . | |
| 4,598,901 | 7/1986 | Thomas . | |
| 4,776,577 | 10/1988 | Marschke et al. . | |
| 4,799,847 | 1/1989 | Bodewein . | |
| 4,811,547 | 3/1989 | Raats et al. . | |
| 4,830,355 | 5/1989 | Jeschke . | |
| 4,886,263 | 12/1989 | Naito . | |
| 4,966,521 | 10/1990 | Frye et al. . | |
| 4,973,039 | 11/1990 | Jeske et al. | 271/151 |
| 5,133,542 | 7/1992 | von Kwiatkowski et al. . | |
| 5,221,079 | 6/1993 | Most et al. | 271/202 |

*Primary Examiner*—H. Grant Skaggs
*Attorney, Agent, or Firm*—Hodgson, Russ, Andrews, Woods & Goodyear, LLP

[57] ABSTRACT

A slow-down apparatus is disclosed using a suction box by itself to slow a sheet of paper in a paper transport apparatus, and to remove the trailing edge of a sheet from the path of the leading edge of an oncoming or following sheet to prevent lead edge damage. A set of high-speed conveyors deliver a sheet above shingled predecessor sheets being drawn by a slowdown conveyor. The shingled sheets "shutter" a suction box beneath them from affecting the delivered high-speed sheet. As the shingled sheets uncover the suction box, the high-speed delivered sheet is affected and drawn to the low-speed conveyor.

26 Claims, 4 Drawing Sheets

NON MARKING SLOW DOWN APPARATUS

FIELD OF THE INVENTION

The invention relates generally to apparatus to slow-down sheets from a web fed folder, sheeter or other in-line equipment within a high speed web printing apparatus or white web equipment, and more particularly to apparatus utilizing the combination of a suction box and low-speed conveyor as the sole means to slow-down and shingle the sheets.

BACKGROUND OF THE INVENTION

A persistent problem in the printing arts is to slow-down and shingle (i.e., partially overlap) sheets traveling at high-speed through a paper transport apparatus (e.g., printing press, or mill sheeter). It is necessary to slow sheets to a velocity, which is a fraction of the printing speed, to stack the sheets without damage. This is particularly true in the case of light-weight product, such as single sheet and four to twelve page signatures. In current high-speed paper transport apparatus, a sheet may be slowed from as much as 2900 feet per minute (fpm) to as little as 200 fpm before stacking. Such drastic changes in velocity over a very short time frame cannot be handled by traditional mechanical slow-down and shingling apparatus.

Mechanical means, such as grabbing and pinching the tail end of a sheet, have been used to slow-down sheets in slower paper transport apparatus. These mechanical means tend to mark (i.e., smear or streak) the ink on a sheet where it is grabbed or pinched when used with higher speed printing apparatus available today. For example, a rotating roller can be timed to pinch the tail of each sheet against a corresponding low-speed conveyor, which tends to "set off" or mark (i.e., smearing or streaking the ink on the sheet at the pinch location) creating waste. One solution to marking is to reduce the pinching force. However, this causes the sheet not to slow as much, potentially leading to damage to the lead edge of the sheet when it hits squaring rollers further downstream at a greater than desired velocity. It is also known that a speed limitation exists to the number of sheets which can be pinched per second without the mechanical grabbing or pinching means being able to remove the trailing edge of the now-slowed sheet from the path of the leading edge of the still rapidly moving following sheet, leading to a collision, damage to the sheets and machine shutdown.

Others have attempted to introduce a suction box to assist in solving these problems in high-speed paper transport apparatus. However, even these solutions are impractical at the very high speeds used by the most recent printing apparatus.

U.S. Pat. No. 3,178,174 to Schneider discloses a slow-down sheeter and shingling apparatus incorporating a suction box and mechanical means to push sheets into the volume affected by the suction box. A sheet traveling at a high speed exits a high-speed conveyor into an area between an upper high-speed conveyor and a lower low-speed conveyor. Beneath this sheet and on the low-speed conveyor are the previously-delivered sheets. The previously-delivered sheets are shingled and traveling at the speed of the low-speed conveyor. The mechanical means is timed to act upon the upper surface of the trailing edge of a sheet as it leaves the high-speed conveyor to push the lower surface of the trailing edge into the volume affected by the suction box located adjacent the exit of the high-speed conveyor and beneath the low-speed conveyor. The suction box pulls the trailing edge of the sheet against the low-speed conveyor. Accordingly, the sheet is slowed to the speed of the low-speed conveyor and the trailing edge of the sheet is removed from the path of the leading edge of the next sheet.

Examples of the mechanical means are a timed, rotating nozzle for compressed air, a rotating press-down bar and a stationary compressed air nozzle. At the high speeds of current printing apparatus, any mechanical means to push a sheet downward will likely limit the speed of operation of the printing apparatus. As the speed of the printing apparatus increases, the time in which the mechanical means can act to push the sheet down decreases until the allocated time to affect the sheet is inadequate. For example, once a certain speed is reached, any of the described mechanical means in Schneider will push down, and the suction box will grab, both the trailing edge of the first sheet and the leading edge of the second following sheet. The second sheet will then bind as its remainder is delivered at high speed over and past its leading edge still held by the suction box. Furthermore, if the mechanical means is then adjusted to act solely on the trailing edge of the first sheet, it may now have insufficient time to push the first sheet into the volume affected by the suction box, thus failing to remove the trailing edge of a first sheet from the leading edge of a second following sheet or causing the suction box to fail to draw the first sheet to the low-speed conveyor.

U.S. Pat. No. 5,133,542 to von Kwiatkowski also uses a suction box to assist in the slow-down of sheets traveling through a high-speed printing apparatus. Similar to Schneider, von Kwiatkowski teaches pushing the top surface of the trailing edge of a sheet toward a suction box positioned below the belts of a low-speed conveyor. In von Kwiatkowski, the leading edge of each sheet is driven upward by a stream of air as it is delivered from the high-speed conveyor driving the sheet out of the volume affected by the suction box, which is adjacent the high-speed conveyor exit. As the trailing edge of a sheet leaves the high-speed conveyor, the stream of air pushes the trailing edge into the volume affected by suction box. The trailing edge is grabbed by the vacuum box and drawn against the low-speed conveyor where it is slowed. Accordingly, multiple sheets freely float above the suction box at any given time, and as the speed of the printing apparatus increases, the likelihood of a mid-air collision that could disorient, mark or bind the sheets increases.

Finally, U.S. Pat. No. 4,436,302 to Frye et al. discloses a slow-down sheeter and shingling apparatus where slow-down rolls alone effect a slow down of each sheet, and a suction box removes the trailing edge of a sheet from the path of the leading edge of a following sheet. In Frye et al., a series of slow-down rollers positioned adjacent or above a low-speed conveyor downstream from a high-speed conveyor sequentially slow a sheet delivered from the high-speed conveyor. A suction box unassociated with the low-speed conveyor and adjacent the high-speed conveyor exit end is used solely to remove the trailing edge of a first sheet from the path of the leading edge of a second following sheet. The suction box in no way assists in slowing the sheet. Frye uses the completely mechanical slow-down rollers for this. It is known that as the speed of the printing apparatus increases, the slow-down rollers will be unable to slow a sheet without marking the sheets.

BRIEF DESCRIPTION OF THE INVENTION

With parenthetical reference to the drawings, for means of illustration only and not limitation, a slow-down system for a plurality of sheets delivered along a delivery path is described.

The slow-down system (10) comprises lower high-speed conveyor (12) having an entrance end and an exit end, a low-speed conveyor (13) having an entrance end and an exit end adapted to receive at the low-speed conveyor entrance end the sheets delivered from the lower high-speed conveyor exit end and adapted to deliver the sheets at a low speed along the delivery path between the low-speed conveyor entrance end and exit end. The slow-down system further comprises at least one upper high-speed conveyor (11). Each upper high-speed conveyor has an entrance end and an exit end. Each upper high-speed conveyor is positioned vertically above at least one of the lower high-speed conveyor and the low-speed conveyor. At least one of the upper high-speed conveyors positioned above the lower high-speed conveyor are adapted to cooperate to deliver sheets (31–34) at a high-speed along the delivery path between the lower high-speed conveyor entrance end and exit end. In addition, a suction box (27) having at least one aperture (30) and capable of affecting a volume (box D) above the suction box is in corresponding relationship with the low-speed conveyor, and is positioned horizontally adjacent the lower high-speed conveyor exit end along the delivery path. The suction box is positioned vertically such that the portion of the low-speed conveyor and delivery path above the aperture pass through the volume the suction box is capable of affecting. The portion of the aperture in communication with said volume above said aperture is a function of the position of the sheets previously delivered (31–33) to the low-speed conveyor relative to said low-speed conveyor. A sheet (34) delivered by the lower high-speed conveyor is drawn to the low-speed conveyor at its rearward marginal end portion (38), temporarily closing the aperture from communicating with said volume above said aperture thus preventing the suction box from affecting any portion of the volume the suction box is capable of affecting.

Accordingly, one object of the invention is to provide a slow-down system where the path of the sheets above the aperture in a suction box is always within the volume the suction box is capable of affecting.

Another object of the invention is to slow-down a sheet delivered from a high-speed conveyor using only a suction box in conjunction with a low-speed conveyor.

Another object of the invention is to slow-down a sheet delivered from a high-speed conveyor without using any mechanical means to press a delivered sheet into the volume affected by the suction box.

Still another object of the invention is to provide a non-marking sheeter and shingling apparatus adapted to be used with current high-speed printing apparatus.

DESCRIPTION OF THE PREFERRED EMBODIMENTS

Figure 1:
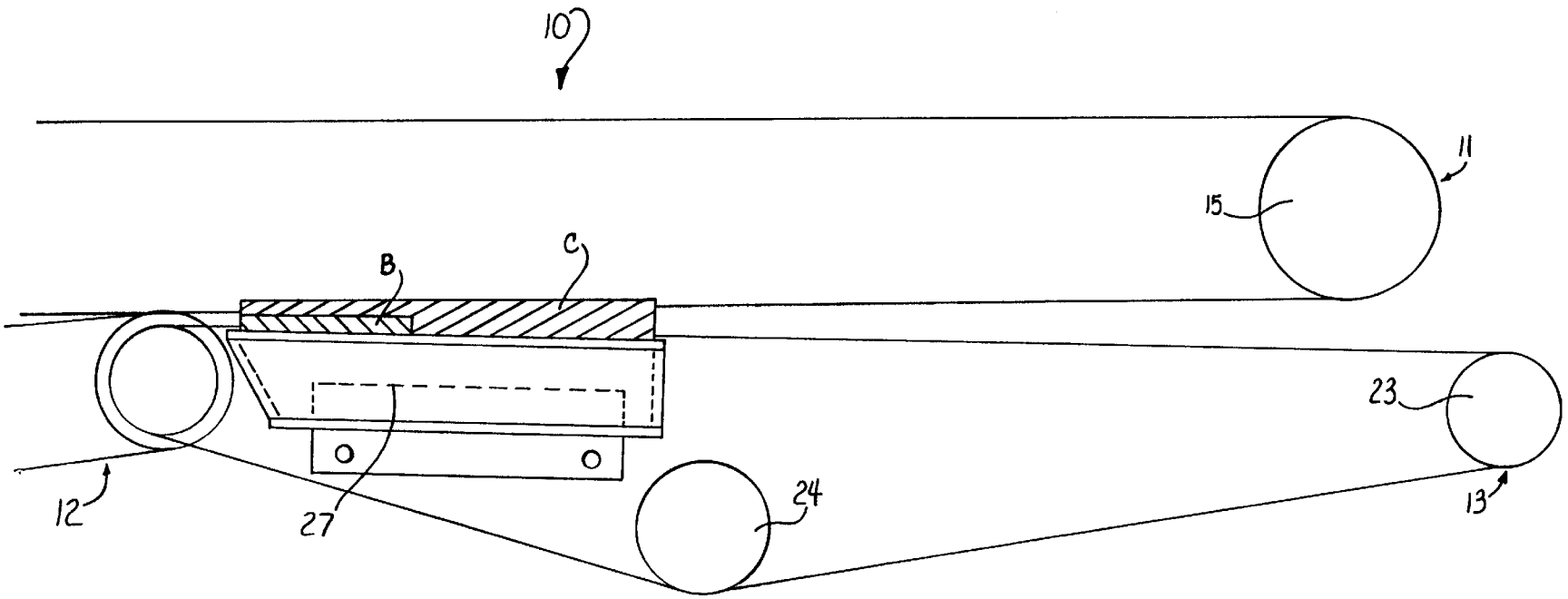
FIG. 1 is a schematic front elevation of the invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
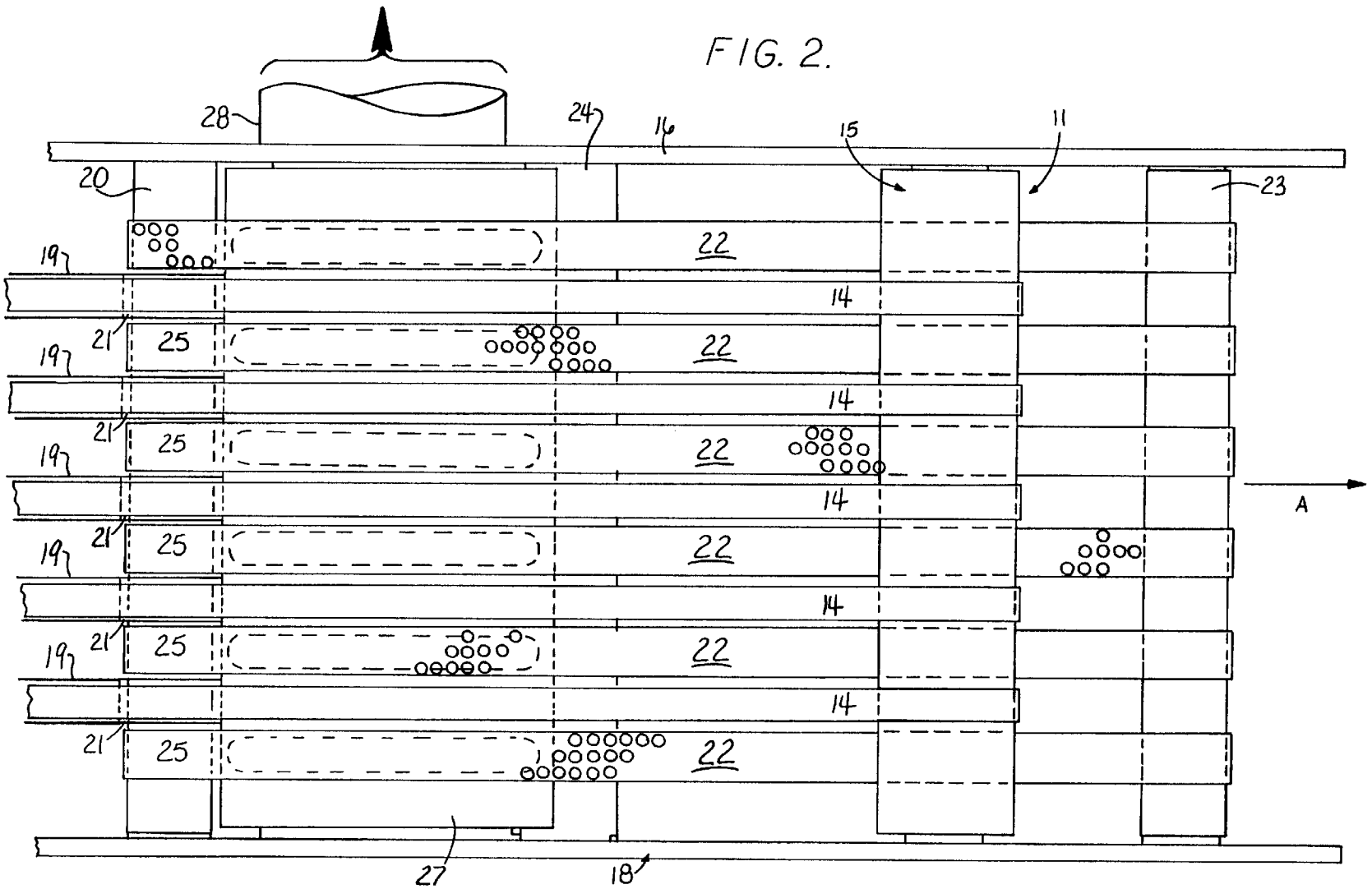
FIG. 2 is a schematic top plan view of the invention.

Adverting now to FIGS. 1 and 2, a portion of a printing press assembly line is shown to include the non-marking slow-down apparatus 10 of the instant invention. Slow-down apparatus 10 is designed to be used with high-speed paper transport apparatus such as printing presses and white web equipment. In a printing press, a continuous web of paper is first passed through the printing press, which makes the ink impressions on the web. The moving web is then immediately passed through an oven to remove solvents and dampening solution retained from the printing process. The web is then cooled down by passing it over chill rollers. At this point, the web is ready to be folded and cut into its final format. After folding and cutting, it is traditional to slow-down and shingle the sheets prior to stacking.

Slow-down apparatus 10 comprises three conveyors: upper high-speed conveyor 11, lower high-speed conveyor 12 and low-speed conveyor 13. High-speed conveyor 11 is best seen in FIG. 2 to include a series of spaced, generally-parallel belts, severally indicated at 14. Belts 14 are wrapped about a drive roller 15 at one end and a second roller, not shown, upstream therefrom. Roller 15 extends between two frames, 16 and 18. Belts 14 are traditionally made of rubberized fabric, but can be made of any elastic, durable low-friction material. In this example, belts 14 are approximately 1"–1½" wide and are separated by gaps of 1"–2". A plurality of upper high-speed conveyors could be used.

Lower high-speed conveyor 12 also includes a series of spaced, generally-parallel belts 19 wrapped at one end about an idler roller 20 extending between arms 16 and 18. Belts 19 wrap idler roller 20 at wheels, severally indicated at 21, having identical radii. Belts 14 of upper high-speed conveyor 11 are in corresponding horizontal arrangement with, and move at the same velocity as, belts 19 such that conveyors 11 and 12 cooperate to draw sheets along a delivery path, indicated at A, at a high-speed. Belts 19 in FIG. 2 are shown to be slightly wider than belts 14 to make understanding of the invention easier. In practice, belts 19 and belts 14 are the same width.

Low-speed conveyor 13 includes a series of spaced, generally parallel belts, severally indicated at 22. Belts 22 wrap about idler roller 20, roller 23 and 24. Rollers 23 and 24 extend between frames 16 and 18. Belts 22 wrap about roller 20 at wheels, severally indicated at 25, having similar radii. The radii of wheels 25 are smaller than the radii of wheels 21. Wheels 21 and 25 rotate independently of one another, allowing belts 19 to be driven faster than belts 22, even though they share roller 20. In the current example, belts 19 travel eleven times faster than belts 22.

Belts 22 are perforated along their entire length with a pattern of openings 26 allowing communication between the lower and upper surfaces of each belt 22. Openings 26 here are circular, but could be any shape.

Figure 3:
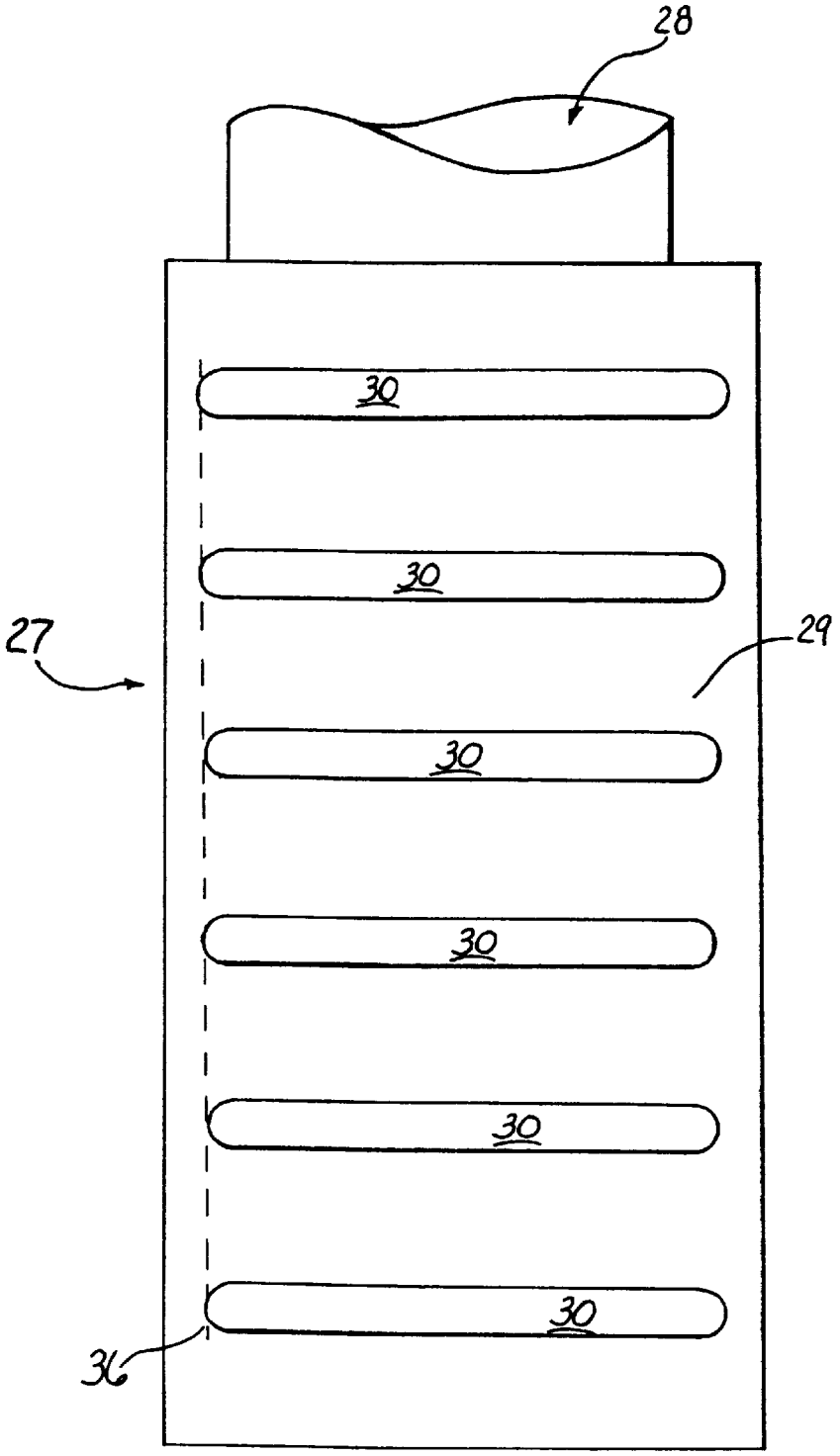
FIG. 3 is a top plan view of the suction box.

A further component of slow-down apparatus 10 is suction box 27. Suction box 27 is best seen in FIG. 3 to be a generally-rectangular box having a duct 28 leading to a suction device, not shown, such as a fan. The top surface 29 of suction box 27 includes a plurality of apertures severally indicated at 30. Apertures 30 are generally parallel to the minor axis of suction box 27, and do not extend the entire length of the minor axis.

As best seen in FIGS. 1 and 2, suction box 27 is positioned within the closed loop of low-speed conveyor 13 immediately adjacent roller 20 along delivery path A such that each belt 22 is drawn along or immediately above top surface 29 and over an aperture 30.

When suction box 27 is activated, the suction device will generate airflow sequentially moving through openings 26 of each belt 22, apertures 30, suction box 27 and duct 28. It is important that the strength of the airflow is capable of affecting delivery path A where it passes above at least the leading marginal portion of apertures 30, designated as box B in FIG. 1. In the preferred embodiment, the airflow generated is capable of affecting a volume, designated as the combination of boxes B and C in FIG. 1, through which delivery path A travels above the entire length of each aperture 30.

EXAMPLE 1

Figure 4:
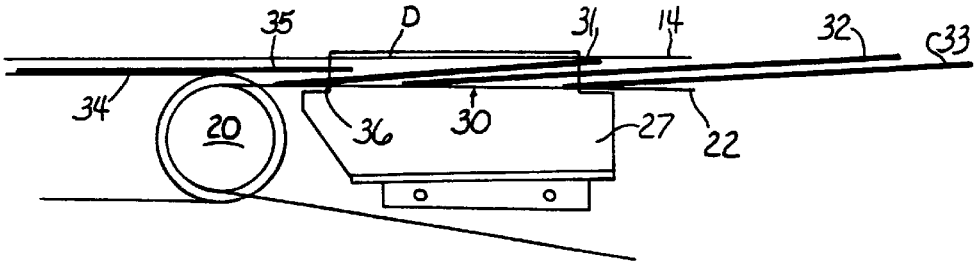
FIG. 4 is a front elevation of a portion of the invention in operation.

FIGS. 4–7 show the slow-down apparatus 10 in operation. In FIG. 4 suction box 27 is configured to affect the volume defined by box D. Three sheets, 31, 32 and 33 are shown shingled against belts 22 of low-speed conveyor 13. Each sheet is 20 pound stock paper approximately 22 inches long in the direction of delivery path A. Low-speed conveyor 22 is moving sheets 31–33 at 200 fpm. High-speed conveyors 11 and 12 move at 2200 fpm. Sheets 31–33 completely prevent suction box 27 from affecting the volume of box D above sheets 31–33 that would normally be affected in the absence of these sheets. Sheets 31–33 in effect "shutter" suction box 27.

Sheet 34 travels between upper and lower high-speed conveyors 11 and 12 and slightly overlaps the trailing edge 35 of sheet 31 due to the differences in velocity between sheets 31 and 34. Approximately two inches of sheet 31 remain upstream from aperture 30.

Figure 5:
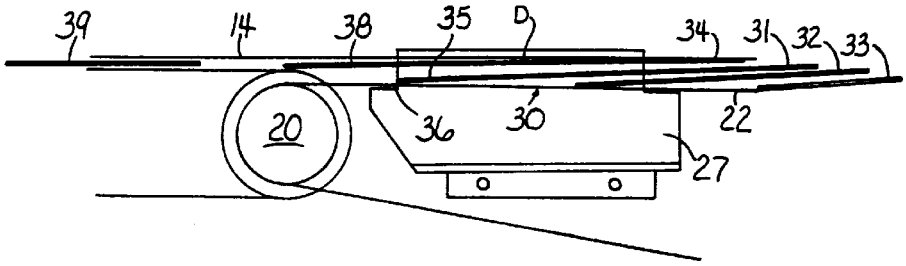
FIG. 5 is a front elevation of a portion of the invention in operation.

In FIG. 5, sheets 31–33 have moved downstream two inches from their positions in FIG. 4, while sheet 34 has moved twenty-two inches downstream based on the differences between the velocity of high-speed conveyors 11 and 12 and low-speed conveyor 13. Sheet 34 continues to be directed by belts 14 from above, although belts 14 no longer drive sheet 34. Trailing edge 35 of sheet 31 is now aligned with the leading edge 36 of aperture 30. Sheets 31–33 still shutter off vacuum box 27. However, any further movement downstream by sheet 31 along delivery path A will open aperture 30. Sheet 34 is substantially over sheets 31–33, except for marginal end portion 38. The entire portion of sheet 34 above aperture 30 is within box D. In other words, if sheets 31–33 were removed, suction box 27 would affect sheet 34, drawing it against belts 22.

Figure 6:
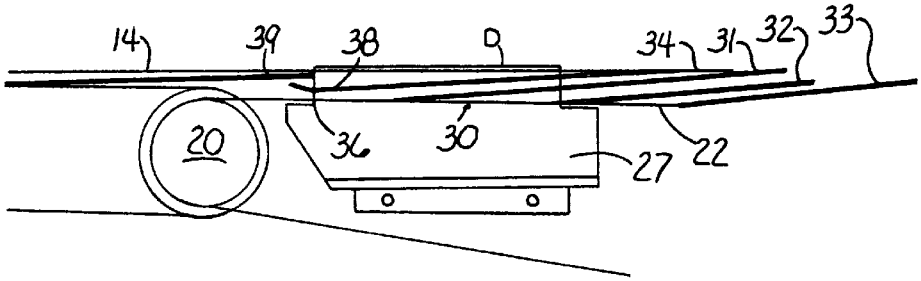
FIG. 6 is a front elevation of a portion of the invention in operation.

In FIG. 6, sheets 31–33 have moved slightly further downstream along direction A, opening a small portion of aperture 30. Aperture 30 is now able to "see" sheet 34 and the strong change in pressure begins to draw marginal end portion 38 toward belts 22. As marginal end portion 38 is drawn toward belt 22, the next following sheet 39 advances over sheet 34, just as sheet 34 advanced over sheet 31 in FIG. 4. Accordingly, suction box 27 alone is used to prevent lead edge damage to a following sheet by drawing the marginal end portion of a predecessor sheet from the path of the following sheet lead edge.

Sheet 34 rapidly decelerates in reaction to the pressure differential force applied at close to a right angle to the direction of the inertia of sheet 34. The inertia of sheet 34 prevents its buckling or binding as suction box 27 asserts further control. Further, the inertia of sheet 34 also keeps it square during this process.

Figure 7:
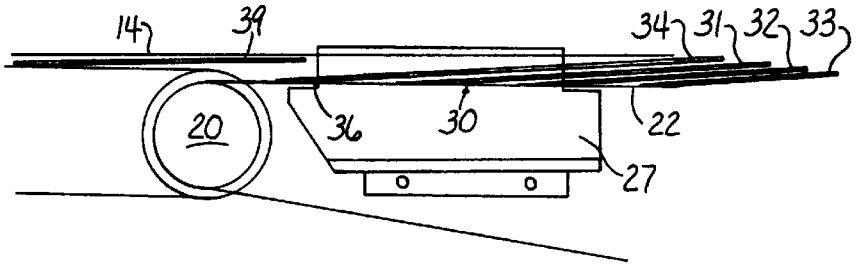
FIG. 7 is a front elevation of a portion of the invention in operation.

FIG. 7 shows sheet 34 being in the same position as sheet 31 in FIG. 4. Sheet 34 is held firmly against belts 22 by suction box 27. A two inch portion of marginal end portion 38 extends upstream from aperture 30. Sheet 34 is now shingled with sheets 31–33.

Slow-down apparatus 10 easily handles the slowing of sheet types having different weights or multiple sheets. Heavier sheets and multiple sheets have greater inertia to overcome than the single sheets in Example 1. Adjusting the shingle depth provided by slow-down apparatus 10 allows the handling of different paper weights and multiple sheets.

EXAMPLE 2

The same initial conditions are present as in Example 1, except the sheets are made of a heavy card stock of approximately 80 pounds. The shingle depth of slow-down apparatus 10 is increased by increasing the speed of low-speed conveyor 13 from 200 fpm to 220 fpm, or a ten to one ratio between high-speed conveyors 11 and 12 and low-speed conveyor 13. Thus, a greater portion of aperture 30 is opened per unit time to affect a following sheet and overcome its inertia. Conversely, a decrease in the velocity of the low-speed conveyor 13 decreases the ability of slow-down apparatus 10 to overcome the inertia of a sheet.

Although the above description only shows one embodiment of the invention, the invention is not limited thereto since one may make modification, and other embodiments of the principal of this invention will occur to those skilled in the art to which the invention pertains, particularly upon considering the foregoing teachings.

What is claimed is:

1. A slow-down system for a plurality of sheets delivered along a delivery path, comprising:

a) a lower high-speed conveyor having an entrance end and an exit end;

b) a low-speed conveyor having an entrance end and an exit end and adapted to convey the sheets at a low-speed less than a high-speed along the delivery path provided between the low-speed conveyor entrance end and exit end;

c) at least one upper high-speed conveyor having an entrance end and an exit end, the at least one upper high-speed conveyor positioned vertically above at least the lower high-speed conveyor;

d) at least one of the upper high-speed conveyor and the lower high-speed conveyor adapted to convey the sheets at the high-speed along the delivery path provided between the lower high-speed conveyor entrance end and exit end to the entrance end of the low-speed conveyor;

e) a suction box having at least one aperture and capable of affecting a volume above the aperture corresponding to at least twice a shingle depth determined by the distance a sheet travels on the low-speed conveyor until a next sheet is delivered to the low-speed conveyor, the suction box in corresponding relationship with the low-speed conveyor and positioned horizontally adjacent the lower high-speed conveyor exit end along the delivery path and positioned vertically such that a portion of the low-speed conveyor and delivery path above the aperture passes through the volume the suction box is capable of affecting to control at least two sheets in the shingled alignment to brake their momentum;

f) the portion of the low-speed conveyor and the delivery path above the aperture communicating with the volume above the aperture the suction box is capable of affecting being a function of the position of the sheets previously delivered from the at least one of the lower high-speed conveyor and the upper high-speed conveyor relative to the low-speed conveyor;

whereby a first sheet delivered by at least one of the upper high-speed conveyor and the lower high-speed conveyor has its marginal end portion drawn to the low-speed conveyor to temporarily close the aperture from communicating with the volume above the aperture the suction box is capable of affecting as the shingled sheets move longitudinally alone the suction box to vacate a portion of the volume the suction box is capable of affecting closest to the entrance end of the low-speed conveyor as a marginal end of a next replacement sheet is drawn toward the low-speed conveyor and the suction box and into a shingled relationship with the sheets in the shingled alignment.

2. The slow-down system of claim 1 wherein the suction box includes a plurality of apertures.

3. The slow-down system of claim 1 wherein the high-speed conveyors and the low-speed conveyor each comprise a plurality of substantially parallel spaced belts.

4. The slow-down system of claim 3 wherein the belts of the low-speed conveyor are perforated.

5. The slow-down system of claim 1 wherein the lower high-speed conveyor exit end and the low-speed conveyor entrance end are wound about a common roller.

6. The slow-down system of claim 5 wherein the common roller supports a first wheel over which the lower-high speed conveyor travels and a second wheel over which the low-speed conveyor travels.

7. The slow-down system of claim 1 wherein when the suction box gains control of the rearward marginal end portion of the sheet, the inertia of the sheet squares the sheet in relation to the delivery path.

8. The slow-down system of claim 1 wherein the first wheel has a larger radii than the second wheel.

9. The slow-down system of claim 1 wherein the high-speed conveyors travel about ten to eleven times faster than the low-speed conveyor.

10. The slow-down system of claim 1 wherein the suction box is provided within a closed loop beneath the delivery path provided by the low-speed conveyor.

11. A slow-down system for shingling a plurality of sheets traveling along a delivery path, which comprises:

a) a lower high-speed conveyor having an entrance end and an exit end and comprising a plurality of substantially parallel spaced first belts;

b) a low-speed conveyor having an entrance end and an exit end and comprising a plurality of substantially parallel spaced second belts, wherein the entrance end of the low-speed conveyor receives sheets delivered from the exit end of the lower high-speed conveyor;

c) at least one upper high-speed conveyor positioned vertically above at least the lower high-speed conveyor; and d) a suction device positioned to create a vacuum zone in a portion of the delivery path provided by the low-speed conveyor adjacent to the exit end of the lower high-speed conveyor, wherein the plurality of sheets are conveyable along the delivery path at a relatively high speed by at least one of the upper high-speed conveyor and the lower high-speed conveyor to deliver the sheets in a shingled alignment at the entrance end of the low-speed conveyor so that the sheets continue along the delivery path at a relatively low speed, shingled with respect to each other at a shingle depth determined by the distance a sheet travels on the low-speed conveyor until a next sheet is delivered to the low-speed conveyor, and wherein the vacuum zone extends longitudinally along the delivery path of the low-speed conveyor beginning adjacent to an entrance end thereof a distance corresponding to at least twice the shingle depth sufficient to control at least two sheets in the shingled alignment such that the suction device serves to brake momentum of a first replacement sheet by drawing a marginal end portion of the first replacement sheet toward the suction device to temporarily block the vacuum zone from affecting the delivery path immediately adjacent to the entrance end of the low-speed conveyor as the shingled sheets move longitudinally along the vacuum zone conveyed by the low-speed conveyor to vacate a portion of the vacuum zone closest to the entrance end of the low-speed conveyor as a marginal end of a next replacement sheet is drawn toward the low-speed conveyor and the suction device and into a shingled relationship with the shingled sheets, wherein the number of sheets held in the shingled alignment by the suction device is determined by dividing the length of the vacuum zone by the shingle depth, and wherein the first belts of the lower high-speed conveyor are rotatable on respective first wheels of a first radii and the second belts of the low-speed conveyor are rotatable on respective second wheels of a second radii less than the first radii with the first and second wheels supported on a common roller such that the sheets drop in vertical elevation when they leave the lower-high speed conveyor and are drawn to the low-speed conveyor by the vacuum zone.

12. The slow-down system of claim 11 wherein the suction device affects a rearward marginal end portion of the plurality of sheets previously delivered to the low-speed conveyor and held in alignment by the vacuum zone such that the length of the marginal end portion of each of the shingled sheets affected by the vacuum zone is a function of a length of each sheet and a length of the vacuum zone and the ratio of the speed of the low-speed conveyor to the high-speed conveyors.

13. The slow-down system of claim 11 wherein the drawing of a rearward marginal end portion of the first replacement sheet to the low-speed conveyor prevents damage to a leading edge of the next replacement sheet delivered to the low-speed conveyor.

14. A method of shingling a plurality of sheets, comprising the steps of:

a) moving the plurality of sheets along a delivery path provided by a slow-down system comprising: a lower high-speed conveyor having an entrance end and an exit end; a low-speed conveyor having an entrance end and an exit end, wherein the entrance end of the low-speed conveyor receives sheets delivered from the exit end of the lower high-speed conveyor; at least one upper high-speed conveyor positioned vertically above at least the lower high-speed conveyor; and a suction device positioned to create a vacuum zone in a portion of the delivery path provided by the low-speed conveyor adjacent to the exit end of the lower high-speed conveyor;

b) conveying the plurality of sheets along the delivery path at a relatively high speed by at least one of the upper high-speed conveyor and the lower high-speed conveyor to deliver the sheets at the entrance end of the low-speed conveyor so that the sheets continue along the delivery path at a relatively low speed;

c) actuating the suction device to create a vacuum zone in the delivery path, wherein the vacuum zone extends longitudinally along the delivery path beginning adjacent to an entrance end of the low-speed conveyor and extending longitudinally a distance corresponding to at least twice the shingle depth sufficient to control at least two sheets in the shingled alignment; and d) vacuum drawing a rearward marginal end portion of a first replacement sheet delivered by at least one of the upper high-speed conveyor and the lower high-speed conveyor to the low-speed conveyor by the suction device to temporarily block the vacuum zone from affecting the delivery path immediately adjacent to the entrance end of the low-speed conveyor as the shingled sheets move longitudinally along the vacuum zone conveyed by the low-speed conveyor to vacate a portion of the vacuum zone closest to the entrance end of the low-speed conveyor as the marginal end of a next replacement sheet is drawn toward the low-speed conveyor and the suction device and into a shingled relationship with shingled sheets.

15. The method of claim 14 including providing the suction device as a suction box having an aperture positioned to direct the vacuum zone to the delivery path.

16. The method of claim 15 including providing the suction box having a plurality of apertures.

17. The method of claim 14 including providing the high-speed conveyors and the low-speed conveyor each comprised of a plurality of substantially parallel spaced belts.

18. The method of claim 14 including providing the lower high-speed conveyor exit end and the low-speed conveyor entrance end wound about a common roller.

19. The method of claim 18 including providing the common roller supporting a first wheel over which the lower high-speed conveyor travels and a second wheel over which the low-speed conveyor travels.

20. The method of claim 19 including providing the first wheel means having a larger radii than the second wheel.

21. The method of claim 14 wherein as the vacuum device draws the rearward end of the first sheet to the low-speed conveyor, inertia of the first sheet squares the sheet in relation to the delivery path.

22. The method of claim 14 including providing the low-speed conveyor with a plurality of perforations.

23. The method of claim 14 including providing the high-speed conveyors travelling about ten to eleven times faster than the low-speed conveyor.

24. The method of claim 14 including providing the suction device within a closed loop beneath the delivery path provided by the low-speed conveyor.

25. The method of claim 14 including drawing a rearward marginal end portion of a plurality of previously delivered sheets to the low-speed conveyor in a shingled alignment such that the length of the marginal end portion of each of the shingled sheets affected by the suction device is a function of a length of each sheet and a length of the vacuum zone, and the ratio of the speed of the low-speed conveyor to the high-speed conveyors.

26. The method of claim 14 wherein the vacuum zone created by the suction device drawing the rearward marginal end portion of the first sheet to the low-speed conveyor prevents damage to a leading edge of the second sheet delivered to the low-speed conveyor.

* * * * *